United States Patent [19]

Shumway et al.

[11] 3,931,905

[45] Jan. 13, 1976

[54] BEVERAGE CONTAINER OPENER AND SEALING DEVICE

[75] Inventors: Roger R. Shumway; Donald C. Bortel, both of Glendale, Ariz.

[73] Assignee: Donald C. Bortel, Glendale, Ariz.

[22] Filed: Dec. 16, 1974

[21] Appl. No.: 532,780

[52] U.S. Cl. ..... 220/278; 30/6.1

[51] Int. Cl.[2] ..... B65D 41/02

[58] Field of Search ..... 220/278; 30/6.1; 222/81, 222/85

[56] References Cited

UNITED STATES PATENTS

| | | | |
|---|---|---|---|
| 2,062,182 | 11/1936 | Kubitz | 220/278 |
| 2,554,173 | 5/1951 | Alexanian | 220/278 |
| 2,784,488 | 3/1957 | Olson et al. | 30/6.1 |

*Primary Examiner*—George T. Hall

*Attorney, Agent, or Firm*—Gregory J. Nelson

[57] ABSTRACT

A combination opener and closure device for press tab type beverage containers is disclosed. The device includes a circular top plate having a downward depending peripheral flange. Integral projections extend from the interior surface of the top plate adapted to align with the weakened tab portion of the can. One embodiment of the device includes an annular seal carried on the flange interior so the device can be used as an effective closure and seal for storage purposes.

3 Claims, 6 Drawing Figures

BEVERAGE CONTAINER OPENER AND SEALING DEVICE

The present invention relates to an opener for beverage containers and more particularly relates to a device for opening cans of the type having press tab tops. One embodiment of the present invention also serves as a closure for previously opened containers.

It is common to provide containers for substances with metal tops having weakened closure areas which have to be depressed by the user. These closures are usually formed by etching or partially cutting a circular outline through the metal in several locations adjacent the periphery of the container top.

Recently, beverage containers, especially those containing malt cereal beverages have adopted a form of the weakened closure design known as the pull tab container. The pull tab container has raised serious objections from conservation groups because of the tendency of the user, particularly after he has consumed a substantial quantity of the contained beverage, to randomly discard the severed pull tabs thereby blighting the park and roadside areas of the countryside. Attempts at educating and reforming these consumers, often designated as "litter bugs," have met with only limited success. More prudent consumers sometimes insert the severed tab into the container. However, this practice is unsafe as the tab can be inadvertently swallowed. Accordingly, container manufacturers and bottling companies have looked for new, improved containers which avoid the disadvantages described above.

One type of container which has recently come into use to avoid the disadvantages of the pull tab containers is the press tab container. The press tab container has weakened closure portions in the top surface. The weakened closure portions can be depressed inwardly into the can, opening the container without separating the closure. Therefore, there is no part of the can to be discarded by the careless consumer. However, even this type of container has disadvantages. Some users have extreme difficulties in applying the force necessary to inwardly depress the tabs. Further the tabs often yield suddenly to pressure so that the thumb or finger is thrust into the opening, resulting in injury to the user.

A number of can puncturing devices for this general type of container can be found in the prior art. Generally these types of perforating devices include a plate carrying one or more sharpened points located to correspond to the weakened closure portions in the container top. the user applies pressure to the plate to cause the sharpened points to perforate or push out the weakened portions. These prior art devices, while effective for their intended use, are not suitable for use with push tab beverage containers. The placement and configuration of the punches are not suited for this purpose and would result in undesirable foaming or fizzing of the contained beverage if used for this purpose.

Therefore, it is apparent that a need exists for a convenient opener for present day push tab beverage cans. To this end the present invention provides an opening and sealing device having a generally circular body portion adapted for engagement with the palm of the user. The inner surface of the body carries a pair of tapered projections designed to align with the weakened press tab portions in the beverage can top. One of the projections is of greater length than the other so that the weakened portions are progressively opened thereby reducing the tendency of the contained liquid to fizz or foam. A circular flange provided around the body portion is adapted to engage the upper sidewall portion of the container. The material of the opener is preferably a transparent plastic so that the projections can be visually aligned with the weakened portions of the can. In another embodiment of the present invention, an annular sealing member is provided on the inside of the circular flange so that the device can be also used to seal the container for storage of the beverage.

These and other objects and advantages of the present invention will become more apparent from the following description, claims and drawings in which:

Figure 3:
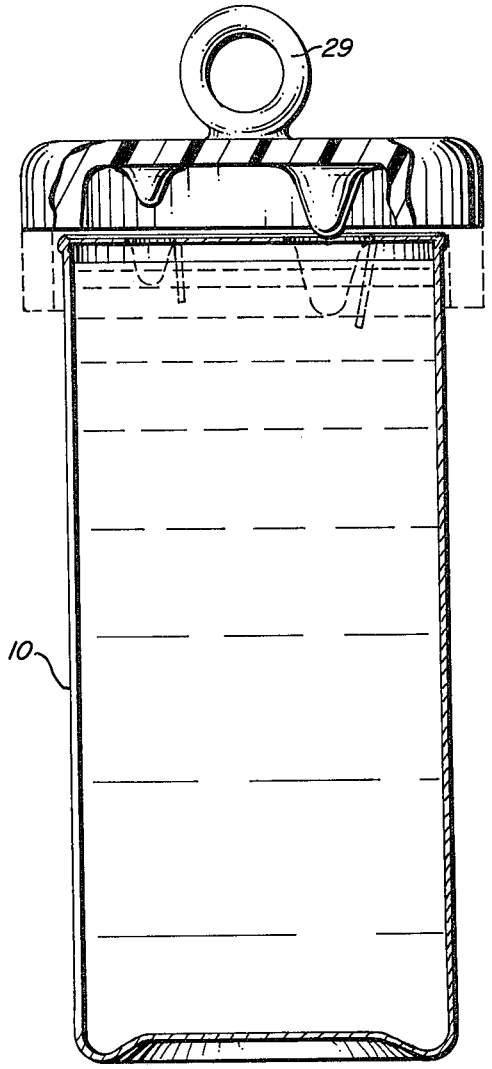
FIG. 3 is a sectional view showing the device of the present invention as applied to a beverage can, the position of the device after opening being shown in dotted lines.

Referring now to the drawings, FIG. 3 illustrates a beverage container of the type having a press tab top and generally designated by the numeral 10. The press tab top includes weakened circular portions 12 and 14 located in the lid 16 of the can. In accordance with the construction of such type containers, tab portion 12 is of smaller diameter than tab 14 and serves as a vent. The contained beverage is poured or directly consumed by means of larger diameter opening formed when tab 14 is depressed. Conventionally, such cans are opened by the user applying downward pressure to the weakened tab portions 12 and 14 to cause them to bend inwardly. The tabs 12 and 14 are not completely severed from the lid 16 and remain in a position depressed toward the interior of the container 10. This eliminates the problem of careless disposal of pull tabs which are completely severed from the can by the user.

As pointed out above, a substantial degree of pressure must be applied to press tabs 12 and 14. Application of pressure by the user's hand can result in injury when the press tab is broken away. Accordingly, the user must often seek the aid of an auxiliary tool such as a can opener or sharp object to depress tabs 12 and 14. This is often not convenient and may be difficult to do and involves a plurality of manual operations. Expediency in the opening of cans of this type are often an important requirement of the consumers of cereal malt beverages.

Figure 1:
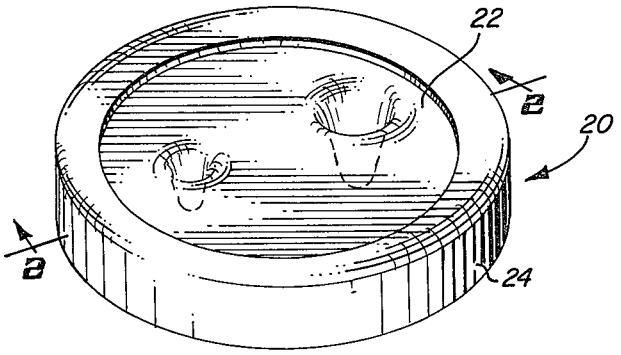
FIG. 1 is a top perspective view illustrating a preferred form of the device of the present invention.
Figure 2:
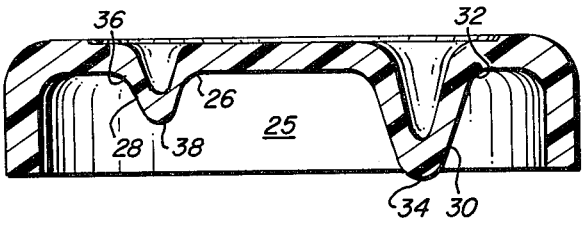
FIG. 2 is a sectional view taken along lines 2—2 of FIG. 1.

FIGS. 1 and 2 illustrate the device of the present invention which is adapted to use with a container of the general type described above and is generally designated by the numeral 20. Opener 20 is of unitary construction having an upper circular plate portion 22. A circular flange 24 projects downwardly at generally right angles from plate 22. The plate 22 and flange 24 therefore forms a cup-like enclosure 25 which conforms closely to the diameter of beverage container 10 and serves to shield the user from fizzing upon opening.

The interior surface 26 of plate 22 is provided with integral projections 28 and 30 depending downwardly. The location of projections 28 and 30 are adapted to correspond in general location to the position of tab portions 12 and 14 on the lid of can 10. The cross sectional configuration of the projections 28 and 30 is best shown in FIG. 2. Each has a generally smooth V-shape. Projection 28 tapers from base 36 to rounded tip 38. Similarly projection 30 extends in a taper from base 32 to tip 34. The diameter of base portions 36 of projection 28 corresponds generally to the diameter of weakened portion 12 of container 10. Base portion 32 of projection 30 corresponds approximately the diameter to the diameter of weakened portion 14 in the top of can 10. Projection 30 is of greater depth than projection 28 as will be explained hereafter.

Any suitable material may be used in construction of the opening device of the present invention. Preferably the material is a transparent plastic to permit the user to readily align projections 28 and 30 with tab portions 12 and 14 respectively on the top of the container 10 to be opened. Materials such as that sold under the names "Plexiglass" or acrylics such as methyl methacrylate and similar thermoplastic materials are suitable. The device may be made by conventional molding methods such as injection molding as an integrally molded finished unit.

The present invention can be used with facility by the consumer as is seen in FIG. 3. To use the present device, the user simply holds or places the container to be opened on a work surface. The opener 20 of the present invention is grasped in one hand and engaged over the top of the can to be opened. Annular handle 29 is shown attached to plate 22 but may be omitted if desired. The transparent construction of the device enables the user to align projections 28 and 30 with the weakened tab portions 12 and 14 on the can top. The user then simply applies slight pressure with the hand or palm of the hand against the outer surface of plate 22 of the device. This pressure will cause projection 30 to first penetrate its associated tab portions. As the can is opened and pressure released, any fizzing of the beverage is shielded by the enclosure 25 of the device. As tab 14 is opened, pressure within container 10 is relieved, further depression causes tip 38 of projection 28 to come in contact with weakened portion 12 of the container and eventually causes the tab 12 to be inwardly depressed. The opener 20 can then be removed and the beverage is ready to be consumed. The opener can also be placed over a partially used container to preserve the contents.

The device of the present invention can be conveniently and easily stored and requires a minimum of space. The design of the opener 20 facilitates cleaning and the generally tapered points 38 and 34 on projections 28 and 30, respectively, do not affort any sharp, dangerous points which can cause injury. As mentioned above, the opener is a dual-purpose device useable as a cover for storage of an open container.

Figure 4:
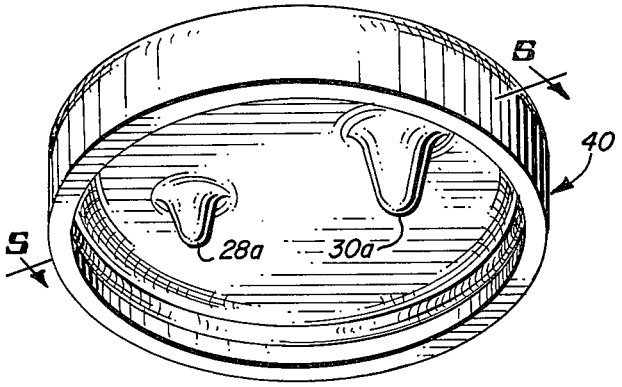
FIG. 4 is a bottom perspective view illustrating another form of the present invention.
Figure 5:
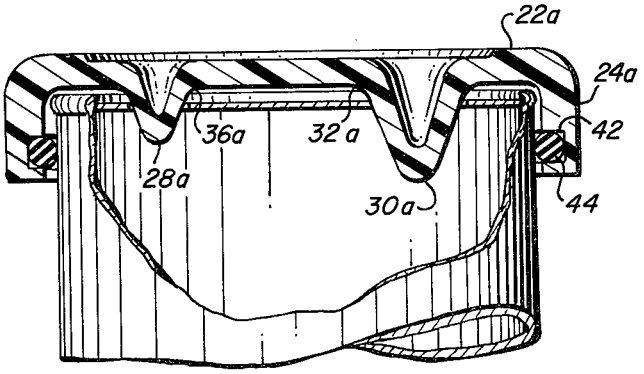
FIG. 5 is a partial sectional view taken along lines 5—5 of FIG. 4 illustrating the embodiment of FIG. 4 in a sealing position on a container.

FIGS. 4 and 5 illustrate an alternate form of the present invention generally designated by the numeral 40. The embodiment 40 includes an upper plate **22*a* and annular downwardly extending flange 24*a*. Projections 28*a* and 30*a* depend from interior surface 26 of the plate. In these respects, the construction and function are similar with respect to the description of the embodiments shown in FIGS. 1 and 2.**

The present embodiment 40, however, includes an annularly extending slot 42 in the interior of the flange **24*a*. A circular seal or O-ring 44 is carried within the annular slot 42. This permits the opener also to serve as a more effective closure in case the user wishes to store the contents of the container after the container has been opened. The user simply places the device 40 over the top of the opened can with the projections 28*a* and 30*a* aligned with the openings in the can lid. Slight downward pressure will cause the device 40 to assume a position with the annular seal 44 engaging the upper outer surface of the can. This seal effectively prevents loss of flavor. Carbonated beverages are particularly susceptible to becoming "stale" if left unsealed. It should also be noted that the base portion 36*a* and 32*a* of the projections 28*a* and 30*a*,** respectively, also serve a sealing function as they engage the periphery of the openings in the can surface. In this way the contents are in effect sealed against loss of flavor and contamination at both the lid and at the outer periphery of the container sidewall.

Figure 6:
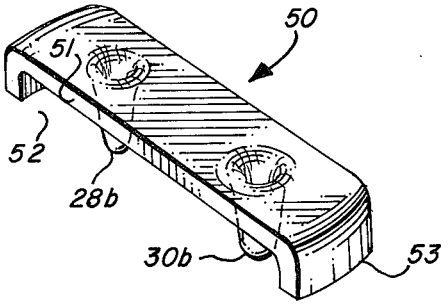
FIG. 6 illustrates another embodiment of the present invention.

FIG. 6 illustrates another embodiment of the invention designated by the numeral 50. This embodiment is functionally similar to the embodiment described with reference to FIGS. 1 to 3, however, is designed to occupy less storage space for convenience. Embodiment 50 includes an elongated body member 51 having flange 52 and 53 at opposite ends. Projections **28*b* and 30*b* extend from body member 51. The device of this embodiment does not completely cover the top of the container to be opened but extends diametrically across the can top with flanges 52 and 53 engaging the container at opposite sides. Body member 51 is preferably of a width somewhat greater than the diameter of projections 28*b* and 30*b*** to afford protection against "fizzing" and for convenience of use.

The present invention is a simple and effective device for opening beverage containers of the type described herein. The present invention also serves as an effective container for previously opened cans. The device is integral and may be conveniently fabricated by conventional molding techniques from a wide variety of plastic materials.

It will be obvious to those skilled in the art to make various changes, alterations and modifications to the embodiments herein described. To the extent that these alterations, changes and modifications do not depart from the spirit and scope of the appended claims, they are intended to be encompassed therein.

I claim:

1. A device for opening containers of the type having a lid with weakened closure portions therein adapted to be inwardly depressed, said device comprising:

a. a generally circular body member adapted to extend across the lid of the container having an inner planar surface;

b. a peripheral lip depending from said body member;

c. projection means depending from the inner surface of said body member arranged to align with said weakened closure points in the container lid, said projection means having a general V-shaped cross section extending uniformly from said inner surface;

d. whereby the device may be snugly engaged with the container with the projection means in alignment with the weakened closure portions and whereby said device can be manually depressed to open said closure portions to bring said planar surface proximate or in contact with said lid to prevent spraying of the container contents upon opening.

2. The device of claim 1 wherein said peripheral flange is provided with annular seal means provided on the interior surface of the flange whereby said device can be used as a closure to seal the contents of an opened container.

3. The device of claim 1 wherein said device is integrally formed of a transparent material.

* * * * *